US008986192B2

(12) United States Patent
Recondo Garcia

(10) Patent No.: US 8,986,192 B2
(45) Date of Patent: Mar. 24, 2015

(54) SPANKING MACHINE

(76) Inventor: Juan Angel Recondo Garcia, Argoños (ES)

( * ) Notice: Subject to any disclaimer, the term of this patent is extended or adjusted under 35 U.S.C. 154(b) by 325 days.

(21) Appl. No.: 13/277,414

(22) Filed: Oct. 20, 2011

(65) Prior Publication Data

US 2012/0101328 A1 Apr. 26, 2012

(30) Foreign Application Priority Data

Oct. 22, 2010 (ES) ..... 201031554

(51) Int. Cl.
*A61F 5/00* (2006.01)
*A63H 13/04* (2006.01)

(52) U.S. Cl.
CPC ..... *A63H 13/04* (2013.01)
USPC ..... 600/38

(58) Field of Classification Search
USPC ..... 600/38; 56/10.2 E; 601/108–111; 15/250.19, 250.21, 250.3
See application file for complete search history.

(56) References Cited

U.S. PATENT DOCUMENTS 3,579,067 A * 5/1971 Riester ..... 318/444
4,211,057 A * 7/1980 Dougherty et al. ..... 56/10.2 E
4,597,129 A * 7/1986 Eustache et al. ..... 15/250.16

* cited by examiner

*Primary Examiner* — Christine Matthews
(74) *Attorney, Agent, or Firm* — Garcia-Zamor IP Law; Ruy M. Garcia-Zamor

(57) ABSTRACT

A spanking machine comprising, fixed to a support, a shaft and a torsion spring, a tensioning hook and an electric gear motor, being the lower end of the spring integrally fixed to the support, whereas the upper end, which extends slightly partially protruding from the ensemble, is situated at the level of a tensioning hook; wherein the hook rotates integrally with the shaft being provided with a mechanism for, in each turn of the shaft, moving the upper end so as to load the spring, adjusting the force accumulated in the spring and releasing the spring; and wherein the upper end of the spring is provided with a fastener for fixing to it the spanking instrument, and the support for allowing the fixation of the machine to a surface.

14 Claims, 4 Drawing Sheets

SPANKING MACHINE

CROSS-REFERENCE TO RELATED APPLICATION

This application claims priority to Spain Patent Application P201031554/5, filed Oct. 22, 2010. The above cited application is hereby incorporated by reference herein as if fully set forth in its entirety.

OBJECT OF THE INVENTION

The invention, as exposed on the wording of the present specification, relates to a spanking machine.

More particularly, the object of the invention is a portable electrically-driven machine whose purpose lies on providing a knocking mechanism, with adjustable rhythm, force and duration, so that an instrument coupled to it, such as a paddle, racket, stick or the like, acquires a repetitive oscillating motion simulating the spanking action manually effected.

APPLICATION FIELD OF THE INVENTION

The present invention is framed within the technical sector of industry focused on the manufacture of automatic electrically-driven instruments and mechanisms, covering essentially the field of sex industry, because it has eminently a purpose as "sex toy" in order to practice as an entertainment, fantasy, game, etc., the so called "English discipline" or Spanking wherein one person spanks to another one, but without being limited to this because, with the proper adaptations to each case, the proposed machine could have a very different purpose, for example in the field of toys industry, for example as a toy for children simulating the movement of a doll, or in the field of small household electrical appliances, as a tool for shaking food pastry, etc.

BACKGROUND OF THE INVENTION

Currently, and referring to the state of the art, it must be pointed that, by the applicant, it is unknown the existence of any other spanking machine or invention with similar application presenting technical, structural and constitutive characteristics similar to the ones presented by the one herein recommended, whose characterizing details are suitably included in the final claims accompanying the present specification.

EXPLANATION OF THE INVENTION

Thus, the spanking machine proposed by the present invention is configured as a remarkable novelty within its field of application, as, according to its implementation and unequivocally, a continuous, automatic, adjustable and portable knocking mechanism is achieved, simulating the spanking action manually effected.

More specifically, the machine of the invention generates, in the instrument coupled to it, an accelerating motion with circular trajectory, with a determined maximum arc, preferably of 220°, returning, after each movement, to its starting point in order to repeat it again with an adjustable rhythm, intensity and duration, thus mimicking the spanking action, i.e., the motion that would be manually gave to an instrument in order to spank with it.

To this end, and now specifically, the recommended machine is essentially configured from a central shaft, fixed and held on its ends by bearings to a frame serving as support to the group of elements forming the machine and allowing also its fixation by means of a clamp or vise system to a surface, being this shaft inserted into a torsion spring, combined to an upper hook, and coupled by the bottom to an electric gear motor which rotates it.

The lower end of the spring is integrally fixed to the lower plate of the frame, whereas the partially protruding upper end is pushed by the mentioned upper hook, so that it is loaded by the torque force transmitted by the motor through the shaft.

The rotation axis in each turn, through said hook, pushes the upper part of the torsion spring tensioning it to a certain extent in which it is released, causing said releasing the returning movement of said end of the spring and the subsequent knock or spank of the instrument (paddle, stick, etc.) which has been fixed to it by any fastening system, for example a bracket clamp.

To this end said hook, which rotates integrally with the shaft but can move freely upwards and downwards regarding to it, presents a flange resting on a perimetral ring intended to this end wherein it exist a ramp-shaped protuberance which raises it in order to release the spring.

Further, said protuberance may be positioned at discretion simply rotating the ring positioning into the collar in which it is incorporated, so as to adjust the force accumulated by the spring.

The motor, which continues rotating the shaft, causes that the hook in the next turn pushes again the upper end of the spring, with the action being repeated.

As it has been pointed, by means of the rotation of the upper ring the knocking force can be precisely controlled, with increasingly intensity, releasing in different positions the spring load.

Furthermore, by incorporating a potentiometer the current intensity applied to the motor can be varied, thus obtaining different revolutions per minute, which will result in a higher or lower speed of the impacts. As well, the machine contemplates the incorporation of a timer so as to be able to schedule the operating time thereof.

Regarding to the support frame, which as it has been stated, has means in order to allow the fixation of the machine to a surface, can be mentioned that it can be made in any type of suitable material, being envisaged that it is preferably of flexible nature so as to offer the possibility of adjusting the machine in different positions and angles.

Finally, regarding to the dimensions of the machine and to the motor it incorporates, both things will depend on the type of knocks desired.

The more force the torsion spring requires to be loaded, logically it will be required a more powerful gear motor, however, one of the particularities of the machine is its simplicity, which allows the generation of greatly accelerated knocks with very much reduced design sizes, which makes it easily portable.

Thus, preferably, the motor it incorporates will be an electric gear motor between 6 and 12 V., with a torque of 30 N, depending upon the torsion spring used. The machine can operate with batteries or being connected to the mains by a converter to the required voltage.

It is confirmed, therefore, that the described spanking machine represents an innovative structure with structural and constitutive characteristics unknown so far to this end, reasons which in combination with its practical utility, provide it with enough basis to obtain the exclusivity privilege which is applied for.

DESCRIPTION OF THE DRAWINGS

In order to complement the description being fulfilled of the machine object of the invention and with the aim of helping to a better understanding of the characteristics of the invention, the present specification is accompanied, as an integral part thereof, by a set of plans, in which by way of illustration and not of limitation, is represented the following.

PREFERRED EMBODIMENT OF THE INVENTION

Figure 1:
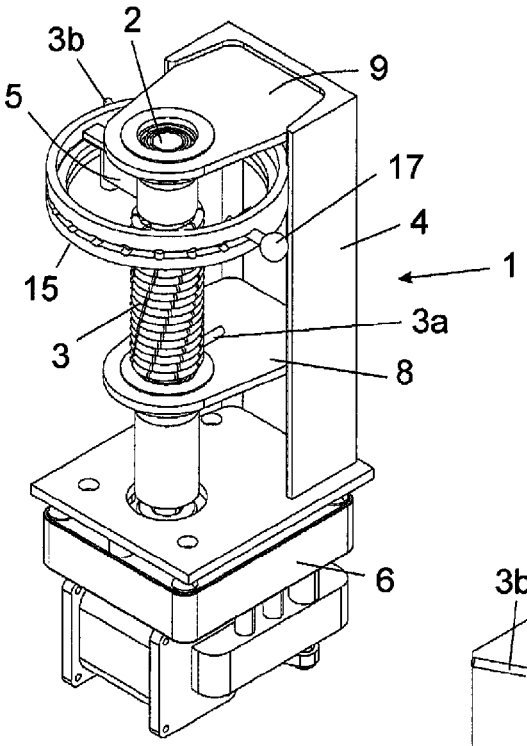
FIGS. 1 and 2.—Show both perspective views of an example of embodiment of the spanking machine object of the invention, being appreciated in them the general external configuration thereof and the main parts and elements it comprises.
Figure 2:
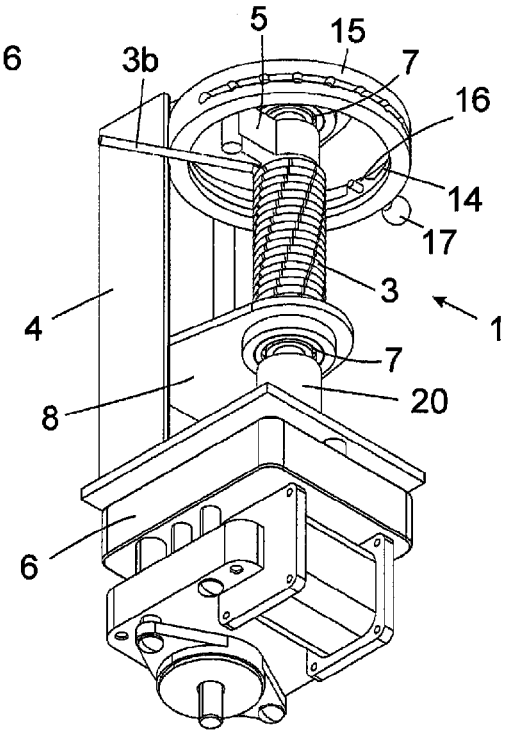
Figure 3:
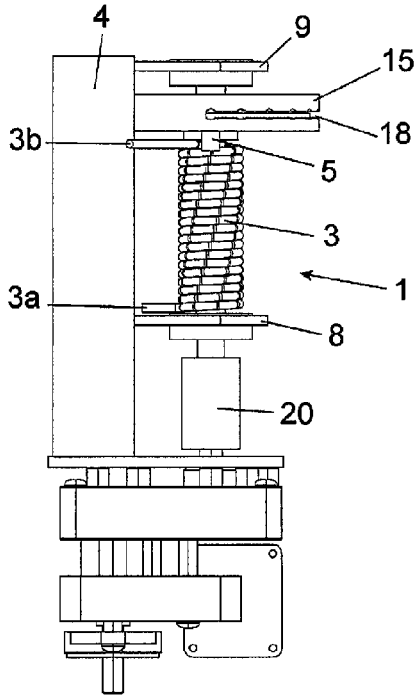
FIGS. 3, 4 and 5.—Show respective side, front and upper plant elevation views, of the example of the spanking machine, according to the invention, shown in the foregoing figures.
Figure 4:
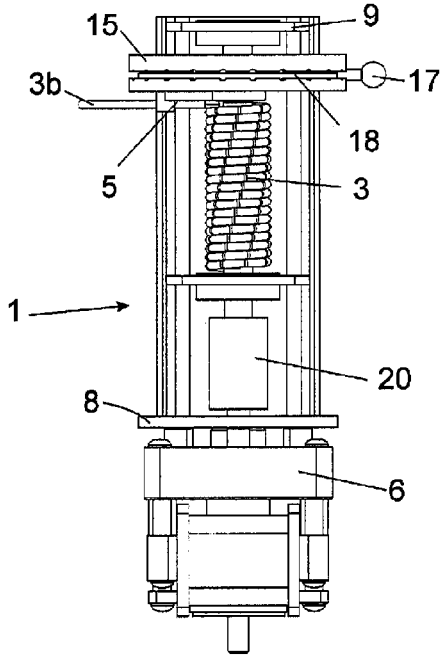
Figure 5:
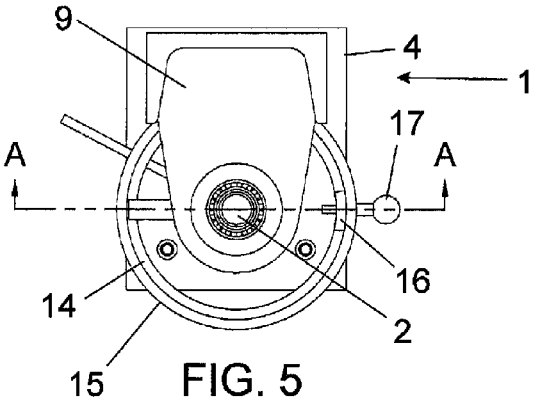
Figure 6:
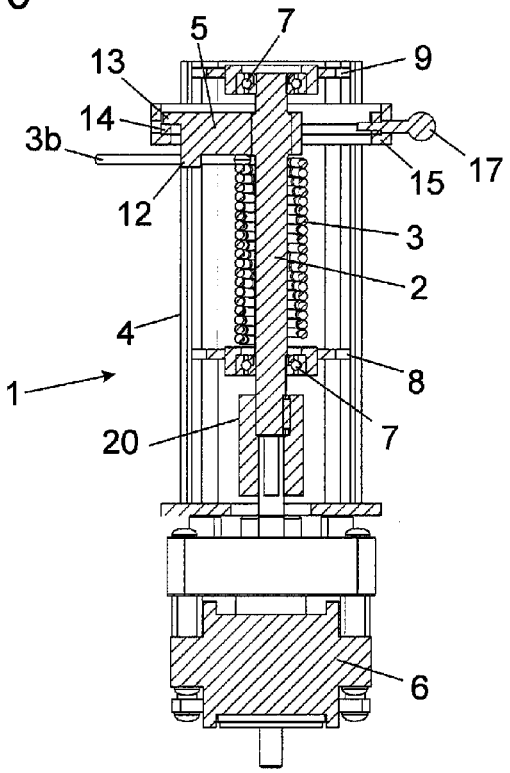
FIG. 6.—Shows a sectional view, according to the section A-A pointed in FIG. 5, of the machine of the invention.

In light of the mentioned figures, and according to the numbering taken, it can be seen on them an example of the recommended invention, which comprises the parts and elements indicated and described in detail below.

Thus, the machine (1) in question from a central shaft (2) axially inserted into a torsion spring (3) and fixed to a support (4), having a tensioning hook (5) and an electric gear motor (6) which rotates it.

Figure 7:
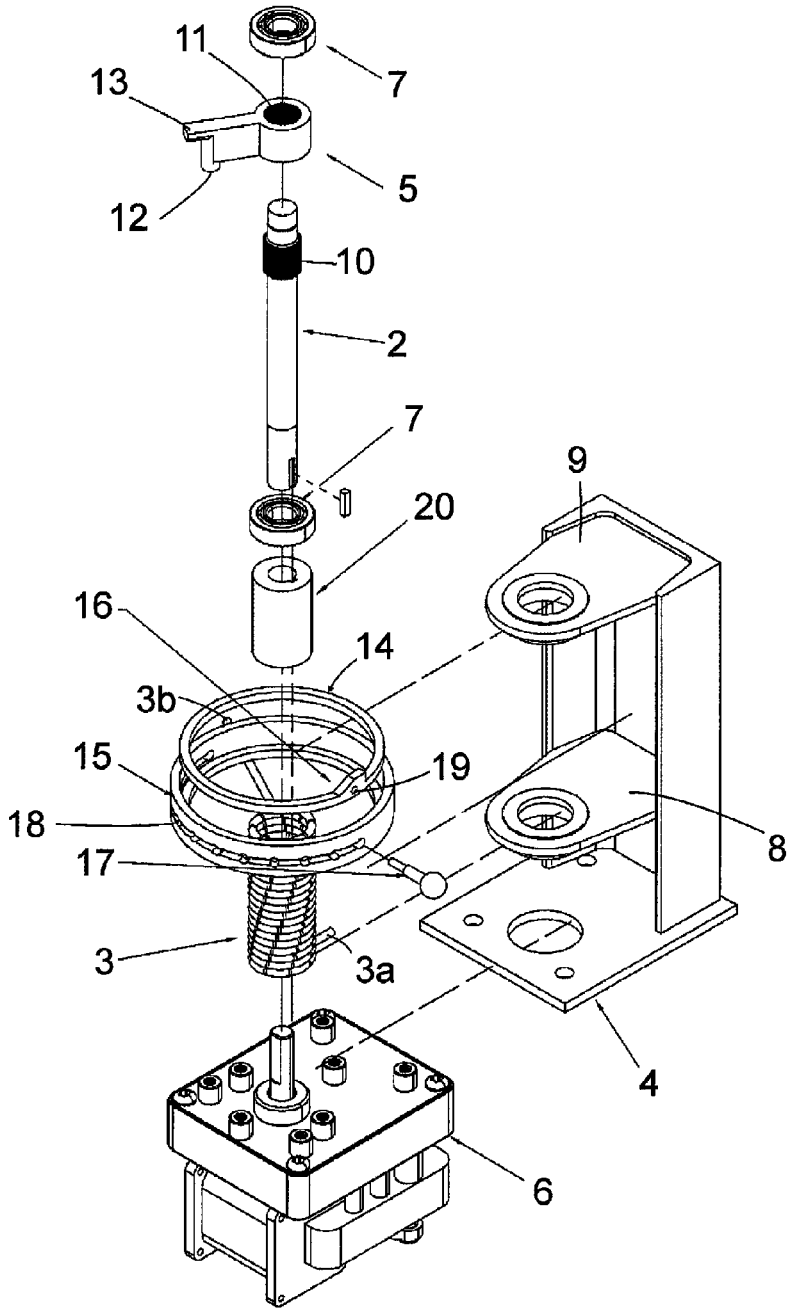
FIG. 7.—Shows a perspective exploded view of the machine of the invention, being appreciated on it all the parts and elements it comprises as well as the configuration and arrangement thereof.

The shaft (2), as is observed in FIG. 7, is coupled and fixed by its bottom to the motor shaft (6) and laterally to the support (4) by both ball bearings (7) which, in turn, are incorporated in both lower (8) and upper (9) plates, intended to this end in said support (4), between which said shaft (2) is framed and, with it, the main functional elements thereof, existing in the lower part a coupling bushing (20).

The lower end (3*a*) of the spring (3) is integrally fixed to the lower plate (8), whereas the upper end (3*b*) is still free and extends slightly partially protruding from the ensemble, resting located at the level of said tensioning hook (5), so that the torque thereof pushes it tensioning the spring (3).

For his part, the hook (5) rotates integrally with the shaft (2) but can move freely upwards and downwards regarding it, because it couples the shaft through the stretch (10) of vertically grooved surface, envisaged in the upper part of the shaft (2), which is complementary to the internal grooving (11) of the bushing of said tensioning hook (5).

This hook (5), further, presents a lower boss (12) which, in the lowest position of the hook (5), abuts against the upper end (3*b*) of the spring (3) and consequently pushes it, and a distal flange (13) resting on a ring (14) inserted inside a collar (15) which, fixed to the upper plate (9), surrounds perimetrally the upper part of the shaft (2) at the level of said hook (5).

Said ring (14) presents a ramp-shaped protuberance (16) which causes the raising of the hook (5) when the flange (13) of the end thereof passes over it (13), causing said hook (5) raising the releasing of the upper end (3*b*) of the spring (3).

Furthermore, in order to adjust the force accumulated in the spring, the protuberance (16) can be varied in angle of position rotating the positioning of the ring (14) into the collar (15) in which it is incorporated, having envisaged a fixation pin (17) which, passing through a slot (18) of the collar (15) with different latching points, is inserted into a hole (19) intended to this end in said protuberance (16), being the length of said slot (18) the one which specifies the maximum path of the spring upper end (3*b*) motion.

The machine contemplates, also, optionally, incorporating to the motor (6) a potentiometer in order to vary the current intensity and be able to adjust the speed of impacts. Also, and optionally too, it is contemplated incorporating a timer in order to schedule the operating time thereof, none of both elements being represented in the figures.

Finally it is worth noting that, on the one hand, the upper end (3*b*) of the spring has a clamp, bracket press or any other similar fastening system suitable for fixing to it the spanking instrument, which can consist of a paddle, racket, stick, etc., and on the other hand, that the support (4), which might be made in any type of suitable material, being envisaged that it is preferably of flexible nature, has means for allowing the fixation of the machine to a surface, such as a vise system or the like.

Having sufficiently described the nature of the present invention, as well as a way of putting it into practice, it is not considered necessary to make a more extensive explanation in order that any expert in this area will understand its scope and the advantages that can be derived from it, making known that, within reason it could be put into practice in other embodiments differing in detail from that indicated by way of example, and which will obtain the same degree of protection, provided that they do not alter, change, or modify its fundamental principle.

What is claimed is:

1. A spanking machine configured to have an instrument coupled thereto, the spanking machine being configured for driving the instrument through a repetitive oscillating motion simulating a spanking action, the spanking machine comprising:

a support;

a shaft rotatably positioned on the support, the shaft having first and second ends and defining a longitudinal axis, the second end having a vertical groove therein;

a torsion spring positioned over the shaft, the torsion spring having a lower end and an upper end, the lower end of the torsion spring being fixed to the support;

a tensioning hook positioned on the second end of the shaft and engaging the vertical groove in the shaft to allow movement of the tensioning hook relative to the shaft along the longitudinal axis;

a motor located on the support and coupled to the first end of the shaft, the motor being configured to continually rotate the shaft in a first direction during operation of the spanking machine;

wherein the upper end of the torsion spring is configured to extend radially outwardly from the shaft to facilitate connection of the instrument thereto, the tensioning hook being configured to rotate the upper end of the torsion spring through a predetermined arc and then disengage therefrom during each rotation of the shaft by the motor, a protuberance being positioned on the support such that during each rotation of the shaft the tensioning hook is disengaged from the torsion spring after rotation of the torsion spring by the tensioning hook resulting in the upper end of the torsion spring moving the repetitive oscillating motion simulating the spanking action, wherein the support further comprises upper and lower plates, the shaft being rotatably coupled to the upper and lower plates via a plurality of ball bearings.

2. The spanking machine of claim 1, wherein the tensioning hook further comprises a bushing that is positioned on the shaft, the bushing having an internal groove configured to engage the vertical groove in the second end of the shaft.

3. The spanking machine of claim 1, wherein the tensioning hook further comprises a lower boss that is configured to abuttingly engage the upper end of the torsion spring.

4. The spanking machine of claim 1, wherein the motor further comprises a potentiometer in order to allow a current intensity to be varied.

5. The spanking machine of claim 1, further comprising a timer engaged with the motor and configured to deactivate the motor after a predetermined period of time.

6. The spanking machine of claim 1, further comprising a clamp located on the upper end of the torsion spring and configured for securing the instrument thereto for driving the instrument through the spanking action.

7. The spanking machine of claim 1, further comprising a bracket press located on the upper end of the torsion spring and configured for securing the instrument thereto for driving the instrument through the spanking action.

8. The spanking machine of claim 1, further comprising a fastener located on the upper end of the torsion spring and configured for securing the instrument thereto for driving the instrument through the spanking action.

9. The spanking machine of claim 2, wherein the support further comprises a collar positioned about the shaft, the protuberance being located on the collar such that the protuberance causes disengagement of the tensioning hook from the upper end of the torsion spring.

10. The spanking machine of claim 2, wherein a collar is configured to allow adjustment of a position of the protuberance thereon to adjust an amount of torsion created in the torsion spring prior to disengagement from the tensioning hook and thereby allow a force with which the instrument is moved through the spanking action to be adjusted.

11. The spanking machine of claim 3, wherein the support further comprises a collar positioned about the shaft, the protuberance being located on the collar such that the protuberance causes disengagement of the tensioning hook from the upper end of the torsion spring.

12. The spanking machine of claim 3, wherein a collar is configured to allow adjustment of a position of the protuberance thereon to adjust an amount of torsion created in the torsion spring prior to disengagement from the tensioning hook and thereby allow a force with which the instrument is moved through the spanking action to be adjusted.

13. A spanking machine configured to have an instrument coupled thereto, the spanking machine being configured for driving the instrument through a repetitive oscillating motion simulating a spanking action, the spanking machine comprising:

a support;

a shaft rotatably positioned on the support, the shaft having first and second ends and defining a longitudinal axis, the second end having a vertical groove therein;

a torsion spring positioned over the shaft, the torsion spring having a lower end and an upper end, the lower end of the torsion spring being fixed to the support;

a tensioning hook positioned on the second end of the shaft and engaging the vertical groove in the shaft to allow movement of the tensioning hook relative to the shaft along the longitudinal axis;

a motor located on the support and coupled to the first end of the shaft, the motor being configured to continually rotate the shaft in a first direction during operation of the spanking machine;

wherein the upper end of the torsion spring is configured to extend radially outwardly from the shaft to facilitate connection of the instrument thereto, the tensioning hook being configured to rotate the upper end of the torsion spring through a predetermined arc and then disengage therefrom during each rotation of the shaft by the motor, a protuberance being positioned on the support such that during each rotation of the shaft the tensioning hook is disengaged from the torsion spring after rotation of the torsion spring by the tensioning hook resulting in the upper end of the torsion spring moving the repetitive oscillating motion simulating the spanking action, wherein the support further comprises a collar positioned about the shaft, the protuberance being located on the collar such that the protuberance causes disengagement of the tensioning hook from the upper end of the torsion spring.

14. A spanking machine configured to have an instrument coupled thereto, the spanking machine being configured for driving the instrument through a repetitive oscillating motion simulating a spanking action, the spanking machine comprising:

a support;

a shaft rotatably positioned on the support, the shaft having first and second ends and defining a longitudinal axis, the second end having a vertical groove therein;

a torsion spring positioned over the shaft, the torsion spring having a lower end and an upper end, the lower end of the torsion spring being fixed to the support;

a tensioning hook positioned on the second end of the shaft and engaging the vertical groove in the shaft to allow movement of the tensioning hook relative to the shaft along the longitudinal axis;

a motor located on the support and coupled to the first end of the shaft, the motor being configured to continually rotate the shaft in a first direction during operation of the spanking machine;

wherein the upper end of the torsion spring is configured to extend radially outwardly from the shaft to facilitate connection of the instrument thereto, the tensioning hook being configured to rotate the upper end of the torsion spring through a predetermined arc and then disengage therefrom during each rotation of the shaft by the motor, a protuberance being positioned on the support such that during each rotation of the shaft the tensioning hook is disengaged from the torsion spring after rotation of the torsion spring by the tensioning hook resulting in the upper end of the torsion spring moving the repetitive oscillating motion simulating the spanking action, wherein a collar is configured to allow adjustment of a position of the protuberance thereon to adjust an amount of torsion created in the torsion spring prior to disengagement from the tensioning hook and thereby allow a force with which the instrument is moved through the spanking action to be adjusted.

* * * * *